United States Patent [19]

List

[11] Patent Number: 4,706,571

[45] Date of Patent: Nov. 17, 1987

[54] SELF-STEERING TRUCKS

[75] Inventor: Harold A. List, Bethlehem, Pa.

[73] Assignee: Railway Engineering Associates, Inc., Bethlehem, Pa.

[21] Appl. No.: 823,081

[22] Filed: Jan. 27, 1986

Related U.S. Application Data

[60] Division of Ser. No. 623,189, Jun. 21, 1984, Pat. No. 4,655,143, which is a continuation-in-part of Ser. No. 948,878, Oct. 5, 1978, Pat. No. 4,455,946, which is a continuation-in-part of Ser. No. 608,596, Aug. 28, 1975, Pat. No. 4,131,069, which is a continuation-in-part of Ser. No. 438,334, Jan. 31, 1974, abandoned.

[51] Int. Cl.[4] ..... B61D 1/00

[52] U.S. Cl. ..... 105/168; 105/176; 105/185; 105/224.1

[58] Field of Search ..... 105/165–168, 105/176, 157 R, 169, 171, 176, 182 R, 182 E, 185, 224.1, 199.1, 218.1; 267/3

[56] References Cited

U.S. PATENT DOCUMENTS

| | | | |
|---|---|---|---|
| 33,167 | 8/1861 | Youmans | 105/176 |
| 220,928 | 10/1879 | Marsters | 105/165 |
| 243,797 | 7/1881 | Robinson | 105/168 |
| 484,186 | 10/1892 | Ellery | 105/166 |
| 502,503 | 8/1893 | Shaw | 105/176 |
| 555,857 | 3/1896 | Graham | 105/165 |
| 894,342 | 7/1908 | Peckham | 105/165 |
| 986,185 | 3/1911 | Lincoln | 105/165 |
| 1,142,379 | 6/1915 | Stevenson | 105/165 |
| 1,640,179 | 8/1927 | Buckwalter | 105/182 R |
| 1,707,046 | 3/1929 | Boyden | 105/165 |
| 1,744,986 | 1/1930 | Richards | 105/168 X |
| 1,772,928 | 8/1930 | Kijlstra | 105/168 X |
| 2,042,623 | 1/1936 | Montrose-Oster | 105/169 |
| 2,296,106 | 9/1942 | Holland et al. | 105/167 |
| 2,360,061 | 10/1944 | Jones | 105/167 |
| 3,054,361 | 9/1962 | Erzer et al. | 105/168 |
| 3,211,112 | 10/1965 | Baker | 105/224.1 |
| 3,274,955 | 9/1966 | Thomas | 105/224.1 |
| 3,528,374 | 9/1970 | Wickens | 105/165 X |
| 3,547,045 | 12/1970 | Cunningham | 105/199.1 |
| 3,690,271 | 9/1972 | Hobbs | 105/167 |
| 3,782,294 | 1/1974 | Sundby | 105/182 R |
| 3,789,770 | 2/1974 | List | 105/168 |
| 3,817,188 | 6/1974 | Lich | 105/224.1 |
| 3,862,606 | 1/1975 | Scales | 105/167 |
| 3,948,188 | 4/1976 | Zehnder | 105/224 R X |
| 4,003,316 | 1/1977 | Monselle | 105/167 |
| 4,067,261 | 1/1978 | Scheffel | 105/182 R X |
| 4,067,262 | 1/1978 | Scheffel | 105/168 |
| 4,131,069 | 12/1978 | List | 105/168 |
| 4,134,343 | 1/1979 | Jackson | 105/167 |
| 4,147,237 | 4/1977 | Mulcahy | 105/168 |
| 4,221,172 | 9/1980 | Sobolewski | 105/168 |
| 4,356,775 | 11/1982 | Paton et al. | 105/218 A |

FOREIGN PATENT DOCUMENTS

| | | | |
|---|---|---|---|
| 450709 | 1/1972 | Australia | 105/168 X |
| 642321 | 6/1962 | Canada | 105/168 |
| 698023 | 11/1964 | Canada | 105/168 |
| 799724 | 11/1968 | Canada | 105/168 |
| 359734 | 1/1962 | Switzerland | 105/176 |

OTHER PUBLICATIONS

List, H. A., An Evaluation of Recent Developments I Rail Car Truck Design, Apr. 21, 1971, American Society Mechanical Engineers Publication.

*Primary Examiner*—Robert B. Reeves
*Assistant Examiner*—Russell D. Stormer
*Attorney, Agent, or Firm*—Kenneth P. Synnestvedt

[57] ABSTRACT

A self-steering railway truck having interconnected steering arms associated with the axled wheelsets and having mechanism for yieldingly resisting yawing motion of the wheelsets including at least two devices, at least one of which provides a relatively high rate of increase of resistance per unit of deflection in the initial portion of the yaw motion and at least another of which provides a relatively low rate of increase of resistance per unit of deflection in a portion of the motion beyond the initial portion.

6 Claims, 11 Drawing Figures

FIG. 6
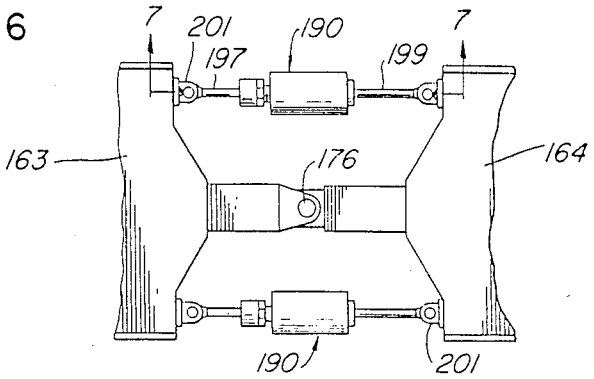
FIG. 7
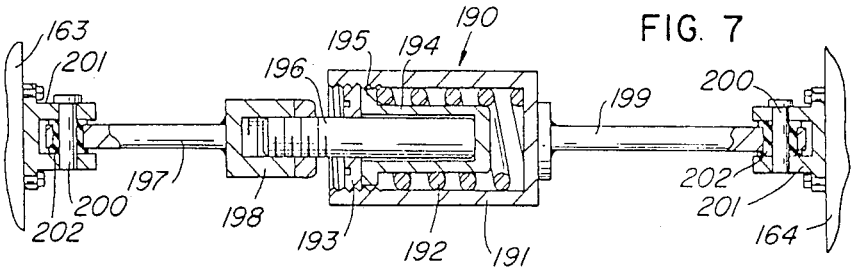
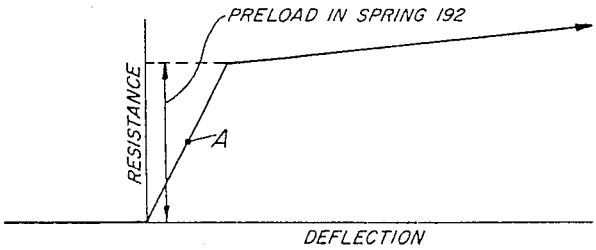
FIG. 8

SELF-STEERING TRUCKS

CROSS REFERENCES

This application is a division of my copending application Ser. No. 623,189, filed June 21, 1984 and issued Apr. 7, 1987 as U.S. Pat. No. 4,655,143, which is a continuation-in-part of my prior application Ser. No. 948,878, filed Oct. 5, 1978, and issued June 26, 1984 as U.S. Pat. No. 4,455,946, which is a continuation-in-part of my prior application Ser. No. 608,596, filed Aug. 28, 1975, and issued Dec. 26, 1978 as U.S. Pat. No. 4,131,069, and which is a continuation-in-part of my prior application Ser. No. 438,334, filed Jan. 31, 1974, now abandoned, which patents and applications are Continuaticns or Continuations-in-part of a group of prior applications, as completely identified in said application 608,596.

BACKGROUND AND SUMMARY OF THE INVENTION

The axles of most of the railway trucks now in use remain substantially parallel at all times (viewed in plan). A most important consequence of this is that the leading axle does not assume a position radial to a curved track, and the flanges of the wheels strike the curved rails at an angle, causing objectionable noise and excessive wear of both flanges and rails.

Much consideration has been given to the avoidance of this problem, notably the longstanding use of wheels, the treads of which have a conical profile. This expedient has assisted the vehicle truck to negotiate very gradual curves.

However, as economic factors have led the railroads to accept higher wheel loads and operating speeds, the rate of wheel and rail wear becomes a major problem.

A second serious limitation on performance and maintenance is the result of excessive, and even violent, oscillation of the truck at high speed on straight track. In such "nosing", or "hunting", of the truck, the wheelsets bounce back and forth between the rails. Above a critical speed, hunting will be initiated by any track irregularity. Once started, the hunting action will often persist for miles with flange impact, excessive roughness, wear and noise, even if the speed be reduced substantially below the critical value.

In recent efforts to overcome the curving problem, yaw flexibility has been introduced into the design of some trucks, and arrangements have even been proposed which allow wheel axles of a truck to swing and thus to become positioned substantially radially of a curved track. However, such efforts have not met with any real success, primarily because of lack of recognition of the importance of providing the required lateral restraint, as well as yaw flexibility, between the two wheelsets of a truck, to prevent high speed hunting.

For the purposes of this invention, yaw stiffness can be defined as the restraint of angular motion of wheelsets in the steering direction, and more particularly to the restraint of conjoint yawing of a coupled pair of wheelsets in a truck. The "lateral" stiffness is defined as the restraint of the motion of a wheelset in the direction paralleling its general axis of rotation, that is, across the line of general motion of the vehicle. In the apparatus of the invention, such lateral stiffness also acts as restraint on differential yawing of a coupled pair of wheelsets.

The above-mentioned general problems produce many particular difficulties, all of which contribute to excessive cost of operation. For example, there is deterioration of the rail, as well as widening of the gauge in curved track. In straight track, the hunting, or nosing, of the trucks causes high dynamic loading of the track fasteners and of the press fit of the wheels on the axles, with resultant loosening and risk of failure. A corresponding increased cost of maintenance of both trucks and cars also occurs. As to trucks, mention may be made, by way of example, to flange wear and high wear rates of the bolster and of the surfaces of the side framing and its bearing adapters.

As to cars, there occurs excessive center plate wear, as well as structural fatigue and heightened risk of derailment resulting from excessive flange forces. The effects on power requirements and operating costs, which result from wear problems of the kinds mentioned above, will be evident to one skilled in this art.

In brief, the lack of recognition of the part played by yaw and lateral stiffness has led to: (a) flange contact in nearly all curves; (b) high flange forces when flange contact occurs; and (c) excessive difficulty with lateral oscillation at high speed. The wear and cost problems which result from failure to provide proper values of yaw and lateral stiffness, and to control such values, will now be understood.

It is the general objective of my invention to overcome such problems by the use of self-steering wheelsets in combination with novel apparatus which maintains stability at speed, and to this end, I utilize an articulated, self-steering, truck having novelly formed and positioned elastic restraint means which makes it possible to achieve flange-free operation in gradual curves, low flange forces in sharp curves, and good high speed stability.

To achieve these general purposes, and with particular reference to railway trucks, the invention provides an articulated truck so constructed that: (a) each axle has its own, even individual, value of yaw stiffness with respect to the truck framing; (b) such lateral stiffness is provided as to ensure the exchanging of steering moments properly between the axles and also with the vehicle body; and (c) the proper value of yaw stiffness is provided between the truck and the vehicle.

With more particularity, it is an objective flexibly to restrain yawing motion of the axles by the provision of restraining means of predetermined value between the side frames and the steering arms of a truck having a pair of subtrucks coupled through steering arms rigidly supporting the axles. Elastomeric means for this purpose are provided between the axles and the adjacent side frames, preferably in the region of the bearing means. Such means may be provided at one or both axles of the truck. If provided at both axles, it may have either more or less restraint at one axle, as compared with the restraint at the other, depending upon the requirements of the particular truck design.

It is a further object of this invention to provide elastomeric means in the region of the coupling between the arms to restrain lateral axle motions, which limits so-called "differential" yawing of a coupled pair of subtrucks or steering arms.

With the foregoing in mind, the present invention provides a truck assembly for use with a railway vehicle on which the truck is adapted to be mounted, the truck assembly comprising at least two axle-borne wheelsets, a load-bearing truck framing pivotally movable about a vertical axis with respect to the vehicle body, a steering arm for each wheelset having load-bearing portions with axle bearings movable with respect to the framing in the steering sense, mechanism interconnecting the steering arms in the region between the axles independently of the load-bearing framing and enforcing coordinated substantially equal and opposite steering motions of the wheelsets with respect to the truck framing, and mechanism for yieldingly resisting yaw motions of the steering arms including means providing a relatively high rate of increase of resistance per unit of deflection in the initial portion of the yaw motion of the steering arms and means providing a relatively low rate of increase of resistance per unit of deflection in a portion of the motion beyond said initial portion.

BRIEF DESCRIPTION OF THE DRAWINGS

FIG. 6 is a plan view of certain control devices adapted for use with various forms of truck steering arms, such as those shown in FIGS. 1A to 1D and 2 to 5;

FIG. 7 is a sectional view of one of the control devices of FIG. 6; and

FIG. 8 is a force diagram illustrating the action of the devices shown in FIGS. 6 and 7.

DETAILED DESCRIPTION

The structure of the truck shown in FIGS. 1A to 1D and 2 to 5 is described below with particular reference to FIGS. 1A, 2, 3, 4 and 5; and the steering action is thereafter described with particular reference to FIGS. 1A, 1B, 1C and 1D.

In connection with the general arrangement or structure of the truck, it is first pointed out that the truck shown utilizes a truck structure incorporating two axled wheelsets, each of which is provided with a steering arm in accordance with the general principles fully described in my U.S. Pat. No. 4,455,946, issued June 26, 1984. The truck also incorporates linkage interrelating lateral motions of the vehicle body to the steering action of the wheelsets. The invention contemplates an interrelation between the lateral motion of the vehicle body and the steering motion of the wheelsets in the following manner. Thus, when travelling on straight or tangent track, if the vehicle tends to hunt or oscillate, as sometimes occurs, particularly at high speeds, the resultant lateral motion itself of the body of the vehicle is utilized, through the use of interconnecting linkage or tow bar mechanism, to introduce corrective steering action between the intercoupled wheelsets. The steering action introduced as a result of hunting of the vehicle body tends to counteract or diminish the hunting, whether this occurs at either low or high speed or on curved or tangent track.

Moreover, when the truck (FIGS. 1D to 5) is operating on a curved trackway above the speed at which the centrifugal force is balanced by the banking of the track (Balance Speed), the vehicle body tends to move outwardly of the curve, and the linkage or tow bar mechanism automatically provides for diminution of the self-steering action of the wheelsets and the interconnected steering arms. When the vehicle is travelling on a curved rail path below the Balance Speed, the laterally inward movement of the vehicle tends to increase the steering action. These actions of the truck, both on straight track and on curved track, are further explained with reference to FIGS. 1A to 1D after description of the structure of that truck, in connection with FIGS. 1A, 2, 3, 4 and 5, as follows.

Figure 1A:
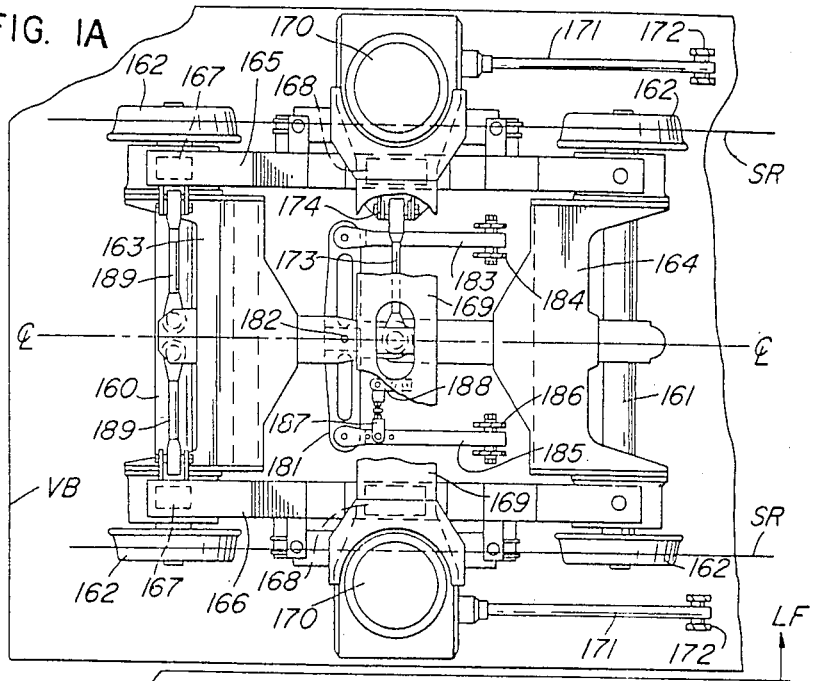
FIG. 1A is a plan view of a truck of a type to which the features of the present invention may be applied, this view showing the truck in relation to a straight rail path.
Figure 2:
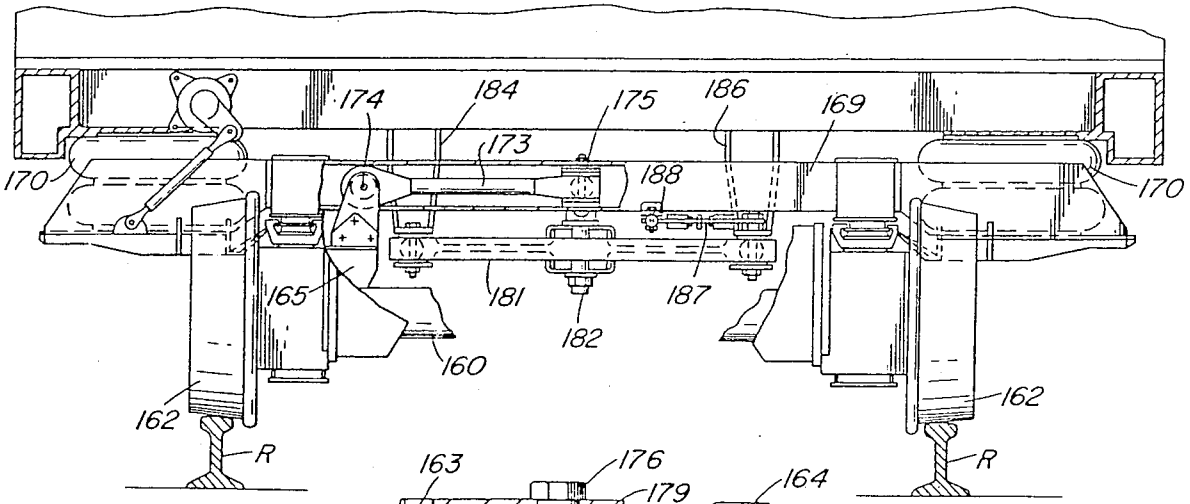
FIG. 2 is an enlarged end view of the truck of FIGS. 1A to 1D.
Figure 3:
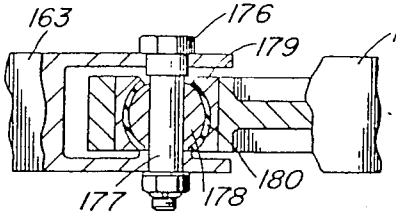
FIG. 3 is an enlarged detailed view of the joint between the steering arms.

In the truck shown, the axles are indicated at 160 and 161, each axle having a pair of flanged wheels 162 adapted to ride on rails such as indicated at R in FIG. 2. The vehicle body is indicated at VB in FIG. 4. In FIG. 1A, the diagrammatic indication of the rails at SR indicates a portion of trackway having straight rails.

Each wheelset is provided with a steering arm, these arms being indicated at 163 and 164, each steering arm having a load-bearing side portion 163*a*, 164*a*, respectively. Each steering arm carries bearing adapters cooperating with the respective wheelsets in the manner described in U.S. Pat. No. 4,455,946 above identified. The truck further includes side frames 165 and 166, the ends of which rest upon the portions of the steering arms associated with the customary wheel or axle bearings. A resilient pad 167 is located between the steering arm and the end of each side frame members 165 and 166 and serves the function of resiliently opposing departure of the wheelsets from parallel relation, under the influence of the self-steering action which occurs when the truck is riding curved trackway, as fully explained in U.S. Pat. No. 4,455,946 above identified.

The side frames also have centrally located pads 168 which receive load from the vehicle body through the bolster indicated at 169. The bolster, in turn, receives the load of the vehicle body through main suspension springs of known type indicated at 170. The position of the bolster with relation to the car body is maintained by the drag links 171, these links being flexibly joined to the vehicle body as indicated at 172.

With the arrangement of the major truck components, the bolster and the vehicle body in the manner described above, the bolster does not yaw relative to the vehicle body, but flexibility is permitted to accommodate lateral motions originating with lateral forces. Lateral motion between the truck side frames and the bolster is limited or controlled by the link 173 which is pivoted at 174 (see FIGS. 1A, 2 and 5) to the side frame 165 and which is pivoted at 175 with the bolster.

The major components of the truck structure briefly described above conform with generally known types of truck construction, and many specific parts of such structures are also described in my prior patent above identified.

Turning now to the steering functions of the truck, it is first pointed out that the central portions 163*b*, 164*b* of the steering arms are interconnected substantially midway between the axled wheelsets by means of a joint indicated generally at 176 (see particularly FIGS.

3 and 5). This joint includes a pivot pin 177 and spherical ball and socket elements 178 and 179, with an intervening resilient element 180. Therefore, the steering arm interconnection provides not only for pivotal motion of the steering arms with respect to each other about the axis of the pin 177, but also provides for angular shift of one of the wheelsets in a vertical plane with respect to the position of the other wheelset.

The steering arms and the interconnection thereof are provided in order to insure coordinated substantially equal and opposite yawing movement of the steering arms and thus also of the wheelsets under the influence of the self-steering forces.

Attention is now directed to the arrangement of the linkage interconnecting the steering arms and the vehicle body, in order to influence the self-steering action of the wheelsets when travelling on curved trackway and, in addition, when the vehicle body moves laterally relative to the truck framing.

The linkages employed, as shown in FIGS. 1A to 5, include linkage parts serving the same fundamental functions as the linkage parts including tow bar 48 and associated mechanism, as described with reference to the embodiment shown in FIGS. 5 to 12 of U.S. Pat. No. 4,455,946 above identified. However, the linkage now to be described is a multiple linkage, instead of a single link, as in my prior patent, and this multiple linkage arrangement is adapted for use in various truck embodiments where clearance problems would be encountered if only a single tow bar link was employed.

In the following description of the multiple linkage arrangement herein illustrated, particular attention is directed to FIGS. 1A, 2, 4 and 5. A lateral or double-ended lever 181 is centrally pivoted as indicated at 182 on the steering arm 163, this pivot 182 being spaced between the joint 176 between the two steering arms and the axle 160 of the outboard wheelset. A link 183 interconnects one end of the lateral lever 181 with a bracket 184 secured to and depending from the vehicle body VB, spherical pivot joints being provided at both ends of the link 183 to accommodate various motions of the connected parts. Similarly, the other end of the lateral lever 181 is connected by a link 185, with a bracket 186 secured to and depending from the vehicle body VB. Pivot or flexible joints are again provided at the ends of the link 185.

Figure 5:
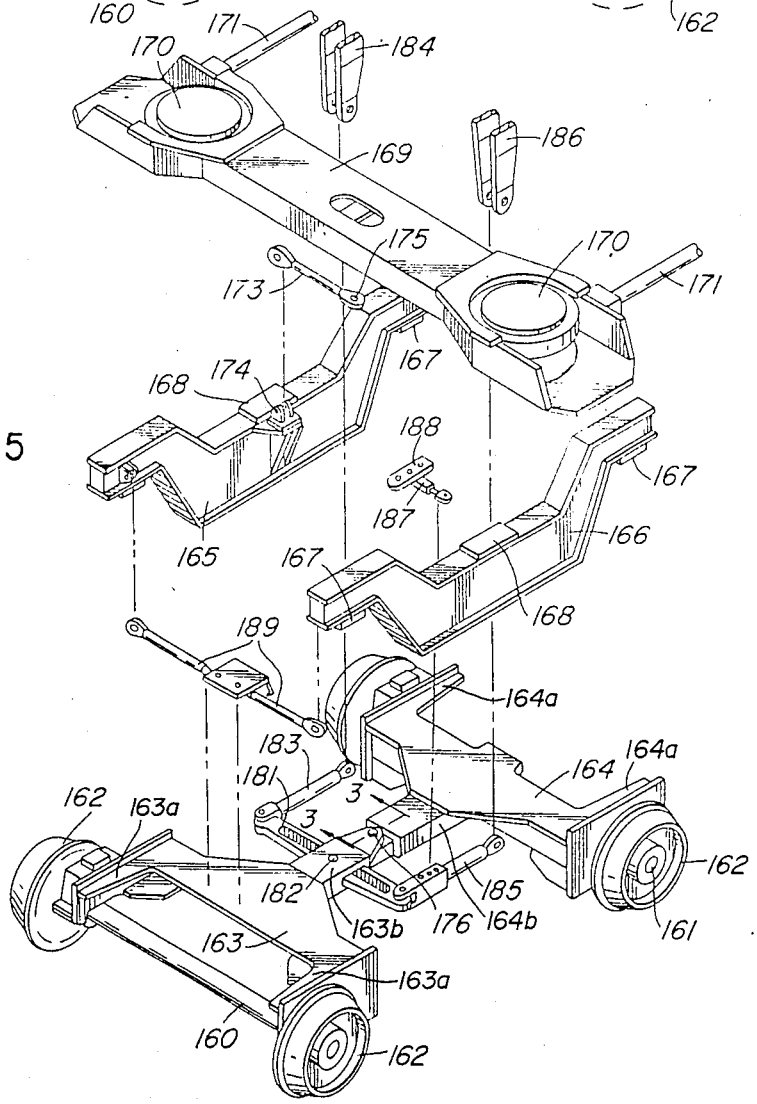
FIG. 5 is a vertically exploded view of the principal parts of the truck of FIGS. 1A to 1D, and 2 and 3.

A reference link 187 is provided between the link 185 and the bolster 169. As best seen in FIGS. 1A and 5, the reference link is pivotally connected at one end with the link 185 and pivotally connected at its other end with a bracket 188 adapted to be mounted on the underside of the bolster 169. The ends of the link 187 are desirably flexibly and pivotally connected with the link 185 and the bracket 188, and in certain embodiments, it is provided with several alternative positions for adjustment of its longitudinal position of the link 187 with respect to the link 185 and the bracket 188. For this latter purpose, several different fastening apertures are provided in the bracket 188 and in the link 185, as clearly illustrated in FIGS. 1A and 5. This permits adjustment of the influence of lateral vehicle body motion on the steering action of the interconnected wheelsets.

Pivoted links 189 between the steering arm 163 and the side frames 165 and 166 aid in maintaining appropriate interrelationships of those parts under the influence of various lateral and steering forces.

Figure 1B:
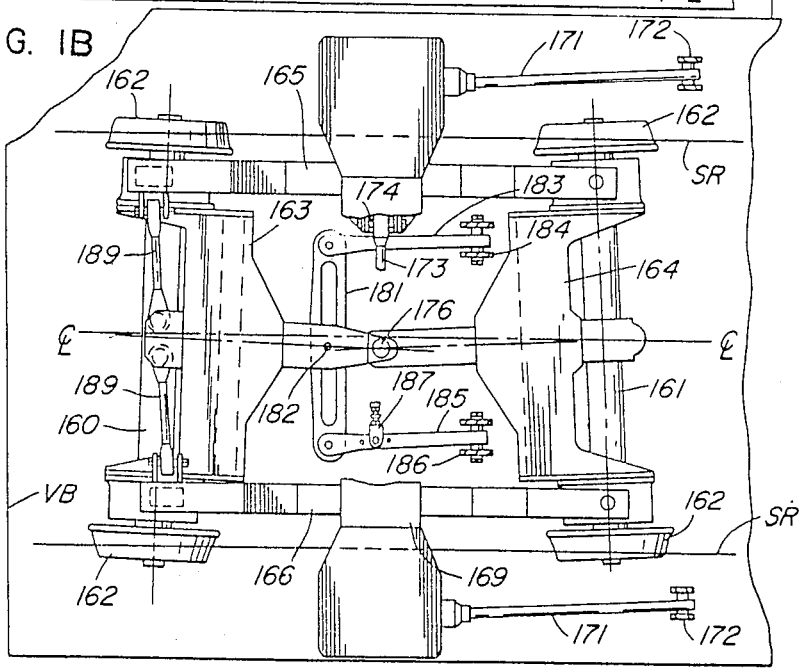
FIG. 1B is a similar somewhat simplified plan view of the truck of FIG. 1A but illustrating the steering motion of the axles with lateral motion of the car body on straight track.

The steering action of the truck just described is illustrated in FIGS. 1A to 1D, and reference is first made to FIGS. 1A and 1B which illustrate the steering action occurring as a result of lateral movement of the vehicle body relative to the truck framing on straight track at high speeds. As seen in FIGS. 1A and 1B, the track on which the truck is travelling comprises straight rail as indicated at SR. In FIG. 1A, all of the parts of the truck, including the axled wheelsets, the steering arms and all of the linkage interconnecting the vehicle body and the steering arms, are located in the mid or neutral position, representing a stable state of travel on straight track without hunting or oscillation. All of the truck parts are thus located symmetrically with respect to the centerline of the vehicle as shown on the figure.

In FIG. 1B, the vehicle body is shown as being shifted in position as indicated by the arrow LF, thereby shifting the centerline of the vehicle upwardly in the figure as is indicated. FIG. 1B thus shows the vehicle body VB shifted laterally with respect to the various truck components, including the bolster 169. Because of the presence of the link 187 between the link 185 and the bracket 188 which is carried on the bolster 169, this lateral motion of the vehicle body with respect to the truck parts introduces a steering motion between the axled wheelsets, so that the axled wheelsets now assume relatively angled positions, being closer together at the upper side of FIG. 1B than at the lower side thereof. This results in introduction of a steering action which tends to neutralize the wheel conicity which, in turn, minimizes steering activity on straight track which otherwise could lead to hunting of the truck or car body.

Figure 1C:
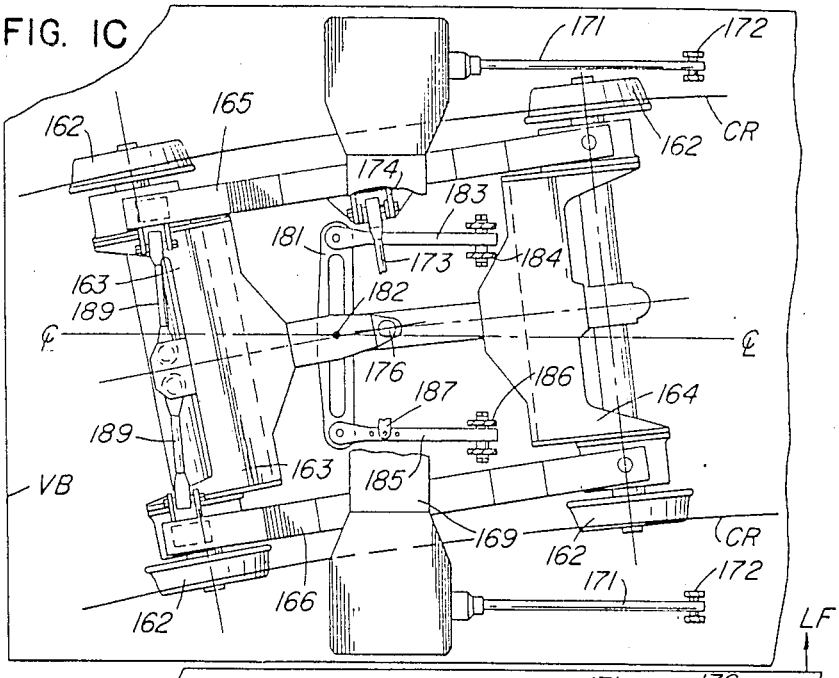
FIGS. 1C and 1D are views somewhat similar to FIGS. 1A and 1B but illustrating a steering function of the truck of FIGS. 1A and 1B on a curved rail path.
Figure 1D:
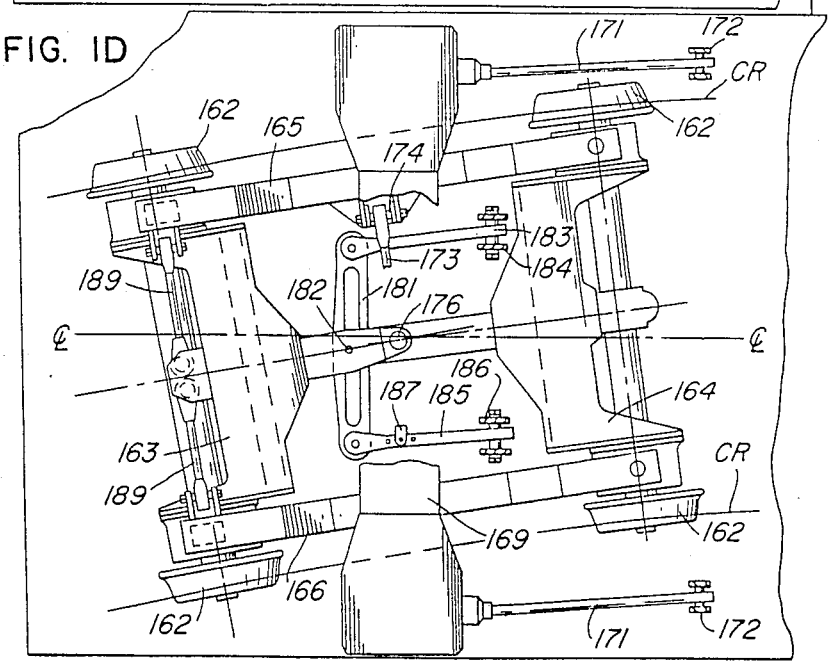

FIGS. 1C and 1D show the activity of the steering parts when travelling on a curved trackway as indicated by the curved rails CR. In FIG. 1C, the effect of the self-steering action of the wheelsets is shown in the absence of lateral displacement of the vehicle body, i.e., with the vehicle travelling at the Balance Speed. It will be seen from this figure that the curved track has set-up steering forces which have caused the wheelsets to assume substantially radial positions with respect to the curved track, the angle of the wheelsets with respect to each other representing a substantial departure from parallelism as is plainly evident from the figure.

In FIG. 1D, the vehicle body has been shown shifted again in the direction indicated by the arrow LF as would occur by outward movement of the body when travelling above the Balance Speed. The effect of this is to shift the position of the steering arms in a direction to diminish the steering action. As appears in FIG. 1D, the steering arms and the wheelsets are in positions representing an appreciable reduction in the angle between the wheelsets.

It will thus be seen that the linkage serves to influence the steering action and also serves as tow bar linkage. It is also to be understood that separate linkages serving the steering and tow bar functions may be employed.

FIGS. 6, 7 and 8 illustrate various aspects of still another steering control mechanism. Only certain parts are shown in these figures, but it is to be understood that the arrangement is to be employed in association with other truck features, for instance, the linkages and various parts included in FIGS. 1A to 5. The arrangement of FIGS. 6, 7 and 8 may be used with a variety of truck arrangements having steering arms for the wheelsets, whether or not tow bar mechanism is incorporated in the truck.

In general, what is included in FIGS. 6, 7 and 8 comprises a special form of mechanism adapted to resist relative deflection of the steering arms of the truck. In various of the embodiments described in my patent above identified, and also in FIGS. 1A to 5, resilient pads are employed between the steering arms and the side frames of the truck, such pads being indicated by the numeral 167 in FIG. 1A and other figures. Those resilient pads yieldingly resist or oppose relative deflection of the steering arms and serve to exert a force tending to return the steering arms to the positions in which the wheelsets are parallel to each other.

I have found that it is desirable to employ in combination with such resilient pads some additional means for resisting relative deflection of the steering arms; and a mechanism for this purpose is illustrated in FIGS. 6, 7 and 8. This means provides non-linear restraint of interaxle and truck frame yaw motions.

In FIGS. 6 and 7, the steering arms are indicated at 163 and 164 and the steering arm interconnecting joint is indicated at 176 (these reference numerals being the same as used in FIGS. 1A to 5).

A pair of devices generally indicated at 190 are employed, one of these devices being shown in section in FIG. 7. Each of these devices comprises a cylindrical spring casing 191 in which a helical compression spring 192 is arranged, the spring reacting between one end of the casing 191 and cup 194. The cylindrical cup 194 is positioned within the spring and has a flange 195 against which the spring reacts, urging the cup flange 195 against the adjustable stop 193. A plunger 196 extends into the cup 194 and is adjustably associated with the rod 197 by means of the threaded device 198. At the other end of the system, a rod 199 is connected with the base end of the cylinder 191 and the two rods 197 and 199 are extended toward the steering arms 163 and 164, as clearly appears in FIG. 6. Each of these mounting rods is connected with the associated steering arm by means of a pivot 200 carried by a fitting 201 which is fastened to the respective steering arms. A resilient device, such as a rubber sleeve 202, serves as the interconnecting element between the associated rod and its pivot 200. The resilient sleeves 202 are capable of deflection and are intended to contribute the relatively high resistance to the initial deflection of the steering arms from the parallel axle position in the manner explained more fully below with reference to FIG. 8.

The spring 192 is preloaded or precompressed between the base of the cylinder 191 and the flange 195 of the cup 194. The plunger 196 is separable from the cup 194 but is positioned in engagement with the base of the cup in the condition shown in FIG. 7. The length of the assembly shown by FIG. 7 is adjusted by the threaded connection between parts 196 and 198 so that the sleeves 202 are brought approximately to point A in FIG. 8 when the axles are parallel. When the steering arms are separated at the side thereof to which the respective device 190 is located, the load in the bushing 202 is reduced and will ultimately become zero, and the plunger 196 will be partially withdrawn from the cup 194. An air cylinder under a preset pressure may alternatively be used in place of the spring 192.

When the steering arms deflect toward each other at one side, the deflection-resisting device at that side comes into action to resist the deflection. Because of the presence of the resilient or rubber sleeves 202, the initial portion of the deflection builds up to a substantial value very rapidly even with a relatively small amount of deflection. When the load exceeds the preload in spring 192, it will be compressed to a shorter length than shown, with a more gradual increase in the resistance than would otherwise be required to obtain the same deflection in sleeves 202.

The combined use of both the resilient sleeves 202 and the preloaded spring 192 results in a pattern of resistance to steering arm deflection which is generally diagrammed in the graph of FIG. 8. The total range of deflection of the resilient sleeves 202 is relatively small, as compared with the total range of deflection provided by the helical spring 192, but the rate of increase of resistance contributed by the resilient sleeves 202 is relatively high per unit of deflection; and the rate of increase of resistance contributed by the spring 192 is relatively low per unit of deflection. This net result is indicated in the graph of FIG. 8. It should be noted that the stiffness of pads 167 between the steering arms and the axle bearings (see FIG. 1A) will cause an additional change in resistance with deflection. This has the effect of introducing a slope to the base line of the graph of FIG. 8.

In the normal position of the parts for small angular motion of the axles, the end of the plunger 196 will exert a nominal force on the base of the cup 194, and only the resilient sleeves 202 will be active.

The high rate of increase of resistance in the initial portion of the deflection is important in providing high speed steering stability on straight track and in gradual curves. The change to a lesser rate of increase for large deflections prevents wheel/rail flange force and the forces within the truck assembly from becoming excessive in sharp curves.

With respect to the embodiment described above with reference to FIGS. 1 to 8, particular attention is directed to the mechanism or devices provided for the purpose of yieldingly resisting yawing motions of the steering arms and thus of the wheelsets with respect to the truck framing.

Figure 4:
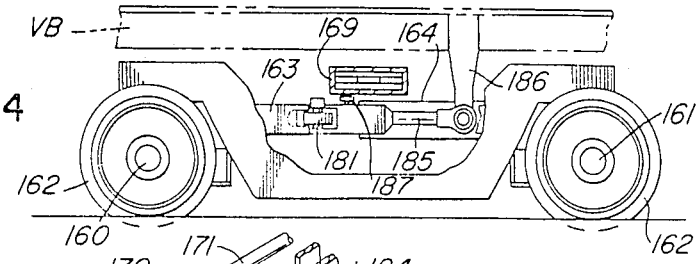
FIG. 4 is a side view of the truck of FIGS. 1A to 1D and 2, with parts of the truck side frame broken out.

In the embodiment illustrated, a combination of several devices is employed for this purpose, including the resilient pads 167, see FIGS. 1A and 4, and the devices particularly shown in FIGS. 6 and 7. The pads 167 resist yawing motion of the steering arms and of the wheelsets by reaction against the truck framing; and the devices of FIGS. 6 and 7, particularly the resilient sleeves 202 and the spring-loaded devices 190, react between the two steering arms 163 and 164. All of these devices constitute means for yieldingly resisting yawing motions of the steering arms and thus of the wheelsets.

Not all of the devices shown in the drawings would necessarily be employed in all embodiments, but in the practice of the invention, it is contemplated that at least two yaw motion resisting devices should be included in the mechanism for yieldingly resisting the yawing motions of the steering arms and the wheelsets. It is contemplated that at least one of said devices, for instance the sleeves 202, provides a relatively high rate of increase of resistance per unit of deflection in the initial portion of the yaw motion. The practice of the invention also contemplates use of another device, for instance the spring-loaded devices 190, providing a relatively low rate of increase of resistance per unit of deflection in a portion of the motion beyond said initial portion.

The resilient pads 167 also provide a resistance to deflection, and depending upon the pad material used and the construction and arrangement of the pads, the pads may serve as a device to resist yaw motion at either a high or low rate of increase of resistance.

Although the mechanism of FIGS. 6 and 7 has been illustrated in a form reacting between the steering arms, rather than between the steering arms and the truck framing, it is to be understood that mechanisms of the type shown in FIGS. 6 and 7 may be provided in a manner extended from a steering arm to a portion of the truck framing. Whether the mechanisms of FIGS. 6 and 7 are used in a manner to react between the steering arms (as is shown in FIGS. 6 and 7) or are used to react between one or both of the steering arms and the truck framing, the action is essentially the same, i.e., the resistance to yawing motion of the steering arms and thus of the wheelsets is yieldingly resisted in a manner providing a relatively high rate of increase of resistance in the initial portion of the deflection, as compared with a subsequent portion of the deflection.

This is an important factor in establishing maximum effectiveness of the steering action on curved track and in minimizing undesirable hunting and other forces on straight track.

It will be understood that whether the yaw-resisting mechanism includes means reacting between the steering arms and the truck framing, or means reacting between the steering arms only, the yaw resistance is effective against the conjoint yawing provided by the interconnection of the steering arms. Slight yielding accommodation of yawing forces as between the two steering arms may also be accommodated by the employment of a flexible component or arrangement, such as the resilient element 180 shown as embodied in the steering arm interconnection joint of FIG. 3.

I claim:

1. A truck assembly for use with a railway vehicle on which the truck is adapted to be mounted, the truck assembly comprising two axle-borne wheelsets, load-bearing truck framing pivotally movable about a vertical axis with respect to the vehicle body, a steering arm for each wheelset movable with the wheelset with respect to the framing in the steering sense, each steering arm having load-bearing side portions with axle bearings movable with respect to the framing in the steering sense under the influence of yawing forces, each steering arm having a central portion movable with the side portions and extended from the side portions to a zone substantially midway between the axles of the wheelsets, the side and central portions of each steering arm being rigidly interconnected for conjoint movement in the yawing sense, pivot mechanism interconnecting the steering arms including a pivot joint in said zone interconnecting said central portions of the steering arms and providing a common upright axis for relative yaw motions of the steering arms independently of the load-bearing truck framing and enforcing coordinated substantially equal and opposite steering yaw motions of the wheelsets with respect to the load-bearing truck framing in either direction from a central position in which the wheelsets are parallel, and means for resiliently resisting steering yaw motions of the steering arms including first resilient means yieldingly reacting between the truck framing and at least one of the steering arms, and said means further including second resilient means reacting between the steering arms independently of the truck framing and yieldingly opposing said coordinated equal and opposite steering motions of the steering arms.

2. A truck assembly as defined in claim 1 in which said first resilient means comprises yieldingly resilient load-carrying pads between the framing and at least one of the associated steering arm.

3. A truck assembly for use with a railway vehicle on which the truck is adapted to be mounted, the truck assembly comprising two axle-borne wheelsets, load-bearing truck framing pivotally movable about a vertical axis with respect to the vehicle body, a steering arm for each wheelset having load-bearing side portions with axle bearings movable with respect to the framing in the steering sense under the influence of yawing forces, each steering arm having a central portion movable with the side portions and extended from the side portions to a zone substantially midway between the axles of the wheelsets, the side and central portions of each steering arm being rigidly interconnected for conjoint movement in the yawing sense, pivot mechanism interconnecting the steering arms including a pivot joint in said zone interconnecting said central portions of the steering arms and providing a common upright axis for relative yaw motions of the steering arms independently of the load-bearing framing and enforcing coordinated substantially equal and opposite steering yaw motions of the wheelsets with respect to the truck framing in either yawing direction from a central position in which the wheelsets are parallel, and motion control means for resiliently resisting yaw motions of the steering arms in either of said yawing directions from said central position including at least two elastomeric devices at least one of which provides a relatively high rate of increase of resistance per unit of deflection in the initial portion of the yaw motion of the steering arms and at least another of which provides a relatively low rate of increase of resistance per unit of deflection in a portion of the motion beyond said initial portion, the motion control mechanism providing for return of the steering arms to said central position in the absence of yawing forces.

4. A truck assembly as defined in claim 3 in which the motion control means for resiliently resisting yaw motions of the steering arms includes resilient pads interposed between the load-bearing truck framing and the load-bearing side portions of at least one of the steering arms.

5. A truck assembly as defined in claim 3 in which at least one of said elastomeric devices is arranged to react between the steering arms.

6. A truck assembly as defined in claim 3 in which both of said elastomeric devices are arranged to react between the steering arms.

* * * * *